US005302051A

United States Patent [19]

Wilson, Sr.

[11] Patent Number: 5,302,051

[45] Date of Patent: Apr. 12, 1994

[54] APPLICATOR BLADE ASSEMBLY FOR RESURFACING APPARATUS

[75] Inventor: Jack H. Wilson, Sr., Jackson, Miss.

[73] Assignee: Koter Industries, Inc., Madison, Miss.

[21] Appl. No.: 821,934

[22] Filed: Jan. 16, 1992

[51] Int. Cl.[5] ..... E01C 19/00; E01C 19/26; E01C 23/02; E01C 19/28

[52] U.S. Cl. ..... 404/84.1; 404/124; 404/89; 404/103

[58] Field of Search ..... 404/84.1, 89, 93, 101, 404/103, 118, 120, 122, 124, 128, 75, 19; 15/159 R, 230.11; 401/208

[56] References Cited

U.S. PATENT DOCUMENTS

| | | | |
|---|---|---|---|
| 635,336 | 10/1899 | Miller | 404/128 |
| 925,714 | 6/1909 | Miller | 404/128 |
| 1,142,698 | 6/1915 | Grove et al. . | |
| 1,401,149 | 12/1921 | Foster | 404/128 X |
| 1,914,950 | 6/1933 | Kanen . | |
| 1,994,437 | 3/1935 | Reis | 94/44 |
| 2,182,217 | 12/1939 | Wahlstrom et al. | 94/44 |
| 2,741,788 | 4/1956 | Shey | 15/105 |
| 3,153,992 | 10/1964 | Dabeile | 94/44 |
| 3,174,413 | 3/1965 | Wittmack, Jr. | 94/45 |
| 3,283,675 | 11/1966 | Gifford et al. | 94/39 |
| 3,703,857 | 11/1972 | MacKinnon | 404/93 |
| 3,841,779 | 10/1974 | Ray | 404/111 |
| 3,873,228 | 3/1975 | Dunham | 404/128 |
| 3,936,209 | 2/1976 | Krage | 404/118 |
| 3,986,226 | 10/1976 | Roe et al. | 15/230.11 |
| 4,070,128 | 1/1978 | Garrison | 404/97 X |
| 4,077,082 | 3/1978 | Roe et al. | 15/230.11 |
| 4,231,678 | 11/1980 | Carternock | 404/128 |
| 4,477,203 | 10/1984 | Laditka | 404/111 |
| 4,492,490 | 1/1985 | Christine et al. | 404/108 |
| 4,597,684 | 7/1986 | O'Brien et al. | 15/230.1 X |
| 4,678,365 | 7/1987 | Ban et al. | 404/118 |
| 4,752,154 | 6/1988 | Valentine | 404/72 |
| 4,789,265 | 12/1988 | Wilson et al. | 404/75 |
| 4,906,126 | 3/1990 | Wilson et al. | 404/75 |
| 4,909,663 | 3/1990 | Freeman | 404/128 |
| 4,917,533 | 4/1990 | Wilson | 404/75 |

FOREIGN PATENT DOCUMENTS

| | | | |
|---|---|---|---|
| 2534387 | 2/1977 | Fed. Rep. of Germany . | |
| 2546928 | 12/1984 | France | E01C 19/20 |
| 217090 | 6/1924 | United Kingdom . | |

*Primary Examiner*—James R. Brittain
*Assistant Examiner*—Nancy P. Connolly
*Attorney, Agent, or Firm*—Nixon & Vanderhye

[57] ABSTRACT

Blade applicator assemblies for resurfacing apparatus are provided for mounting forwardly and rearwardly of the apparatus frame. Each forward and rearward blade applicator assembly comprises an elongated base member, and an elongated blade assembly mounted to the base member. The rearward blade applicator assembly also includes an elongated roller extending rearwardly from the base member.

25 Claims, 3 Drawing Sheets

APPLICATOR BLADE ASSEMBLY FOR RESURFACING APPARATUS

BACKGROUND OF THE INVENTION

This invention relates to a novel applicator blade assembly for use with a resurfacing machine of the type described in my earlier U.S. Pat. Nos. 4,906,126 and 4,917,533, both of which are expressly incorporated herein by reference. The machines as described in the above mentioned patents, as well as in a third prior patent, i.e., U.S. Pat. No. 4,789,265, were designed for resurfacing tennis courts, parking lots, warehouse floors and the like. A significant aspect of these prior machines is the incorporation of free-floating forward and rearward applicators for smoothing and spreading the acrylic composition. The forward applicator in one embodiment of my prior machine was provided with a leading squeegee type blade and a trailing brush, while the rearward applicator was provided with leading and trailing brushes. The applicators as described in my prior patents are particularly beneficial when applying coating material (such as acrylic) of relatively low viscosity and in relatively thin layers, e.g. 12–15 mils. There remained a need, however, for an applicator assembly which would reliably and uniformly distribute thicker coating material including cementitious materials as typically used in parking lot applications, for example.

The blade applicator assembly in accordance with this invention has been found to be particularly useful with thicker coating material (up to 150 mils or more) of greater viscosity, and including cementitious materials. The blade applicator assembly of this invention may be mounted on my prior machine in the same manner as (and are interchangeable with) the forward and rearward applicators described in my above identified prior patents. For applications such as multi-coat systems for parking lots, the applicator assemblies of my prior patents and the blade applicator assembly disclosed herein may be selectively used to apply the various components of the multi-coat system as will be described in greater detail herein.

In accordance with an exemplary embodiment of the invention, the blade applicator assembly, which is designed for use as both forward and rearward applicators, includes an elongated, channel member or beam which supports a plurality of squeegee blades, aligned end-to-end, from one end of the base member to the other. At the interface between adjacent blades, a (rubber) squeegee flap is employed to cover the interface gap or seam to thereby prevent coating material from passing between adjacent vertical edges of the respective squeegee blades. The lower edges of the aligned blades are notched, with openings varying in size depending on the thickness of the coating to be applied.

The blades are sandwiched between rigid plates which, in turn, are attached to the channel member or beam by means of a plurality of spring loaded rods, enabling the blades to individually self-adjust in a vertical direction as the machine travels over uneven floors.

In another aspect of the invention, an elongated roller bar is pivotally secured to the channel member, extending rearwardly therefrom, and adapted to roll the coating previously uniformly distributed by the forward, notched squeegee blades. The roller bar is designed to receive interchangeable roller covers, the selection of which depends on the coating material applied. The roller serves to apply a final surface texture to the coating material, and to remove any air bubbles (i.e., aerate) present in the material, and as such, is secured to the rearward applicator assembly only.

Another feature of the invention relates to the utilization of vertically oriented end blades extending perpendicularly with respect to the spring loaded squeegee blades, on both forward and rearward applicator assemblies. These end blades, which may be laterally adjustable, extend forwardly from opposite ends of the applicator, and are mounted for self-adjusting up and down movement as determined by floor surface and gravity. These end blades serve to confine the coating material within the area defined by the applicator assembly per se.

Accordingly, the present invention in its broader aspects relates to a resurfacing apparatus for distribution and smoothing of a predetermined thickness of coating material on a surface, the apparatus comprising at least one applicator assembly having first means for spreading the material uniformly over the surface at the predetermined thickness, and second means for texturing and aerating the material, the first means located forward of the second means relative to a direction of travel of the resurfacing apparatus.

In another aspect, the present invention relates to a resurfacing apparatus comprising a central frame supported by a plurality of wheels; a plurality of support arms extending forwardly and rearwardly of the central frame; a forward blade applicator assembly secured to the support arms extending forwardly of the central frame; a rearward blade applicator assembly secured to the support arms extending rearwardly of the central frame; wherein each of the forward and rearward blade applicator assemblies comprises an elongated base member and an elongated blade assembly mounted to the base member, and further wherein the trailing blade applicator assembly includes an elongated roller extending rearwardly from the elongated base member.

The above described blade applicator assemblies may be formed in desired lengths, as dictated by the machine length, and the area to be resurfaced. The have significant advantages in that, by the judicious selection of blade notch size and roller cover nap, coatings of various thicknesses up to about 150 mils may be applied in a uniform and attractive manner with extensive savings in both time and cost. Moreover, these blade applicator assemblies may be used in combination with the applicator assemblies of my prior patents for application of complex, multi-coat resurfacing systems.

Additional objects and advantages of the present invention will become apparent from the detailed description which follows.

DETAILED DESCRIPTION OF THE DRAWINGS

Figure 1:
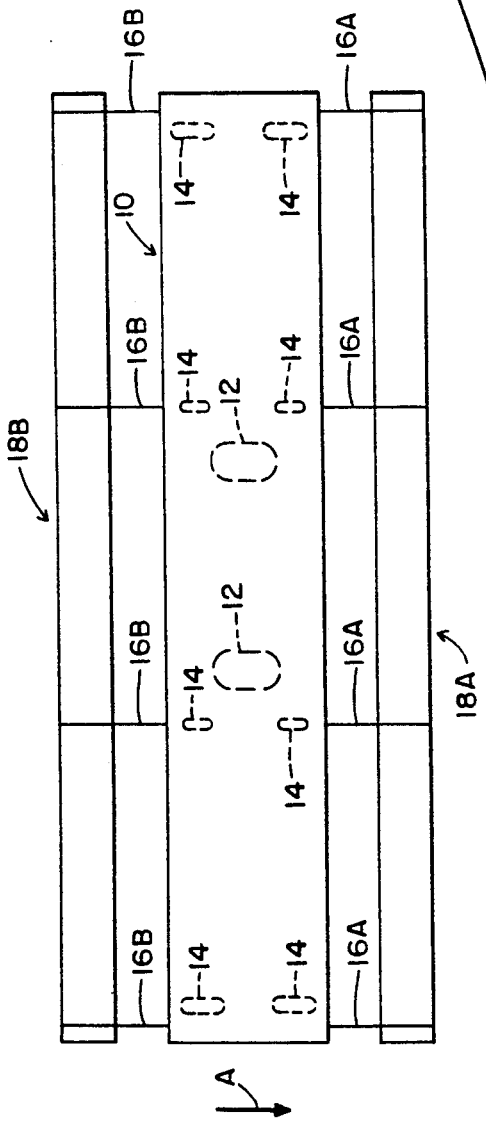
FIG. 1 (PRIOR ART)
FIG. 1 is a schematic plan view of resurfacing apparatus of the type disclosed in my two above identified prior patents.

With reference to FIG. 1, a machine generally as disclosed in my two above identified prior patents is shown in a simplified, schematic form, and includes a central, elongated structural frame 10 driven by a pair of drive wheels 12 and additionally supported by a plurality of freely rotatable casters 14. The details of the machine construction, drive and steering assemblies form no part of this invention and may be found in my above identified prior patents.

As shown in FIG. 1, a plurality of support arms (corresponding to arms 93 in my prior patents) are pivotally secured to the central frame 10 and extend forward and rearwardly therefrom. The arms 93 are pivotally secured to the frame for movement about a horizontal axis, i.e., the arms are pivotable toward and away from the floor.

Free-floating applicator assemblies 18A, 18B are shown attached to support arms 16A, 16B as also described in my above identified prior patents. For convenience, and for facilitating the description of the present invention, applicator 18A may be regarded as a forward applicator and applicator 18B as a rearward applicator, relative to a direction of travel indicated by arrow A.

With reference now to FIGS. 2-5, a blade applicator assembly 20 in accordance with the present invention is shown in detail. Initially, and as described in greater detail below, it will be understood that the blade applicator assembly of this invention will replace the forward and rearward applicator assemblies 18A, 18B as shown in FIG. 1, and will be attached to the support arms 16A, 16B in the same manner. In the present invention, however, upon attachment of the blade applicator assemblies to the arms 16, screw down devices 17 (FIG. 4) are utilized to limit the arms to downward movement only, i.e., the arms are prevented from pivoting upwardly beyond the horizontal position illustrated in FIG. 4. In this way, good contact with the floor or surface is assured at all times during operation. Since the forward and trailing applicators in accordance with this invention are essentially identical (with one significant exception as noted below), only one need be described in detail.

Figure 2A:
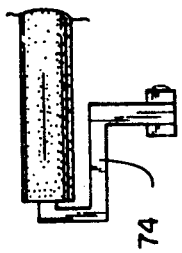
FIG. 2A is a partial plan of a roller support strut in accordance with an alternative embodiment of the invention.
Figure 2:
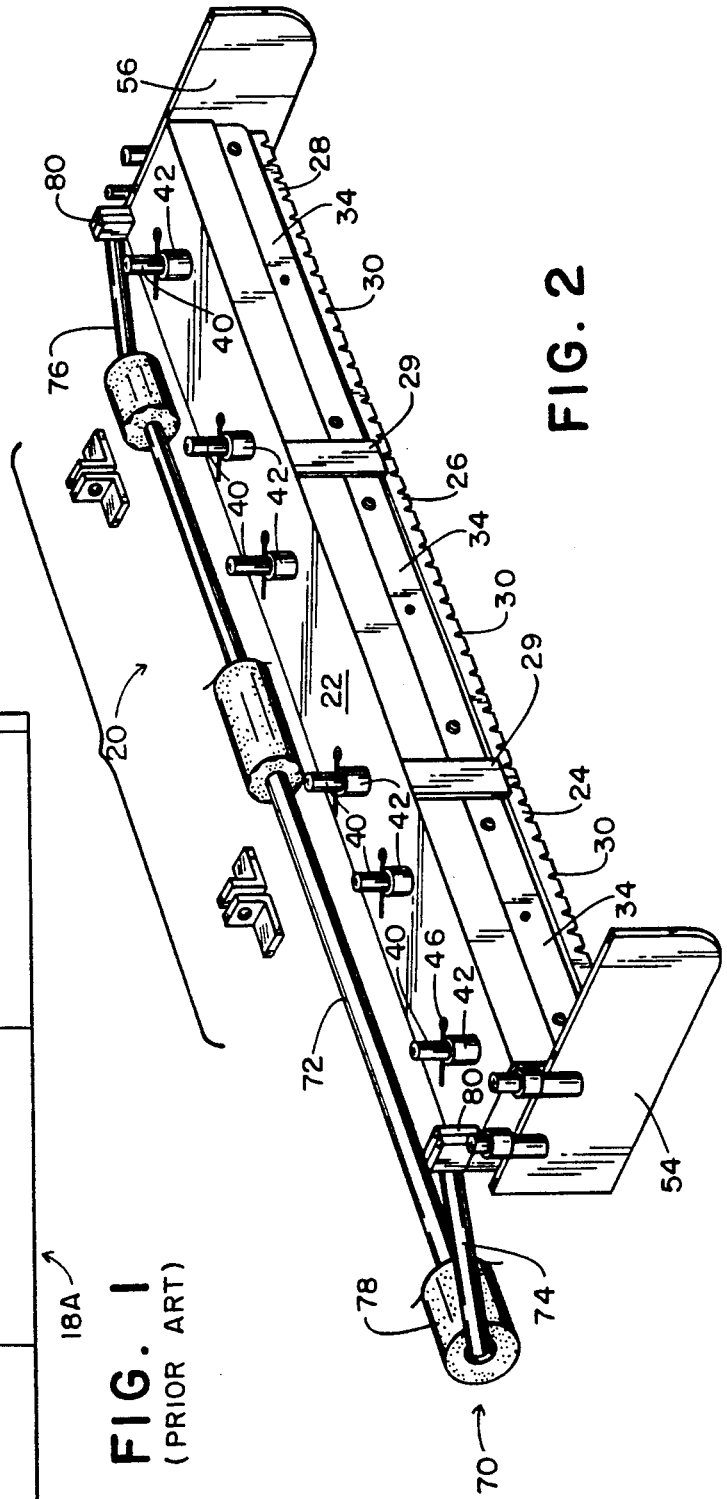
FIG. 2 is a perspective view of a blade applicator assembly in accordance with an exemplary embodiment of the invention.
Figure 3:
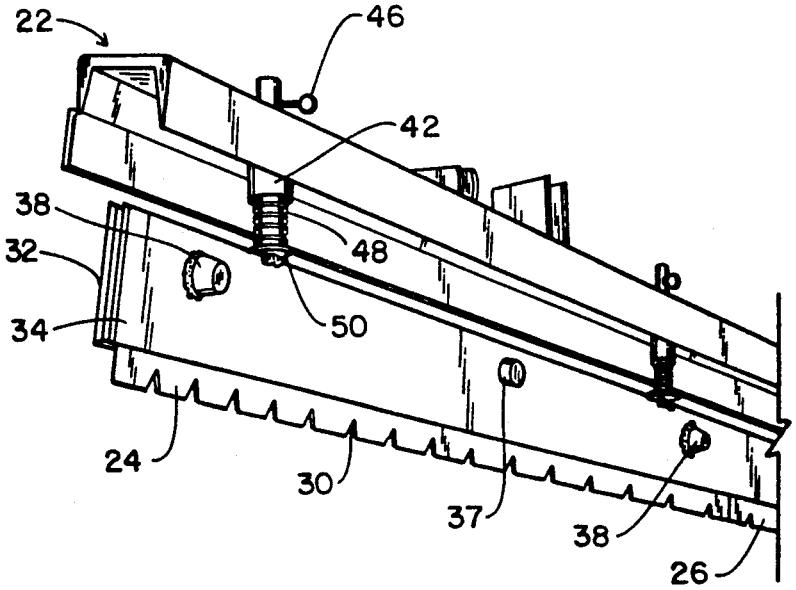
FIG. 3 is another perspective view of a portion of the blade applicator assembly illustrated in FIG. 2, and specifically illustrating the manner of attachment of the blades.
Figure 4:
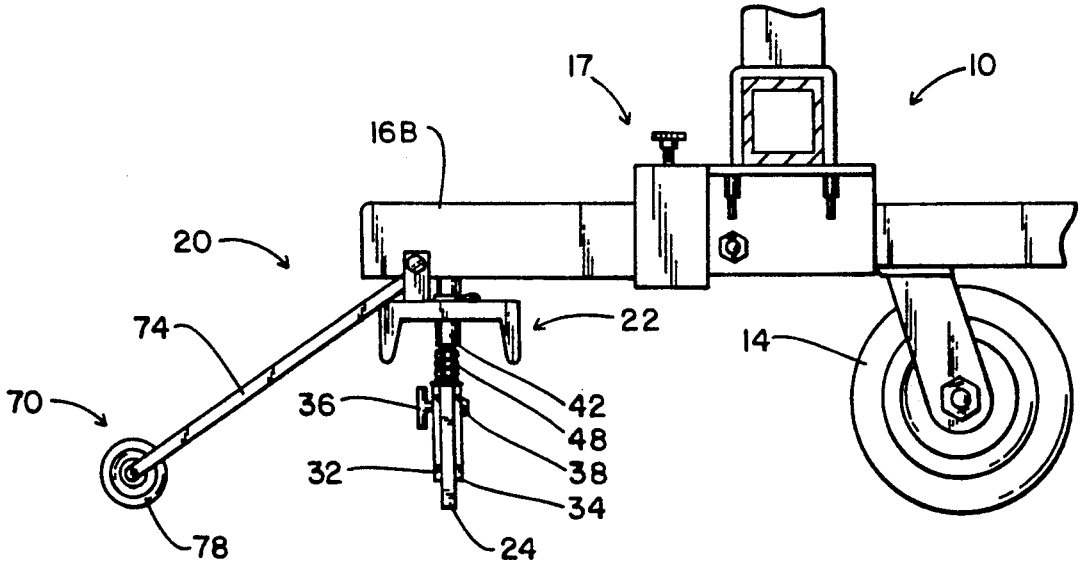
FIG. 4 is a side view, partially in section, illustrating the blade applicator assembly of FIG. 2.

The blade applicator assembly 20 includes an elongated channel member or beam 22 which, as best seen in FIGS. 2 and 3, has an inverted U-shape. In the exemplary embodiment, the beam 22 is formed of 4" wide channel iron with a 72" length. The channel member or beam 22 supports a plurality (three in the exemplary embodiment) of notched squeegee blades 24, 26 and 28, in end-to-end alignment so that the three blades 24, 26 and 28 extend substantially the full length of the channel member or beam 22. The blades are preferably formed of a neoprene rubber material each having a 24" length, 2" width and ¼" thickness, and the lower ends of the blades are notched as at 30, with triangular-shaped openings. The vertical dimension of the openings may vary from about ⅛" to about ¾", depending on the thickness of the coating material to be applied.

As illustrated in FIGS. 2 and 3, the blades 24, 26 and 28 are each sandwiched between a pair of rigid plates 32, 34. Since each blade is secured between its associated plates and mounted to the channel member or beam 22 in the same manner, only one such blade mounting need be described in detail. The blade 24 is clamped or compressed between plates 32, 34 by means of a pair of compression knobs 36 and integral threaded rods (not shown) which extend from knobs 36 through aligned apertures (not shown) in the plates, and which are threadably received within nuts 38 welded to the forward face of plate 32 in alignment with the apertures. Thus, by rotating knobs 36 clockwise in the conventional manner, the blade 24 will be securely clamped between the plates 32, 34. By rotating the knobs 36 in the opposite direction, plates 32, 34 will be loosened, permitting removal and replacement of the blade 24.

In the exemplary embodiment, the upper edge of each blade abuts the associated pair of threaded rods attached to the corresponding knobs 36 (as well as an intermediate pin 37 located centrally between each pair of knobs and extending from one of the plates 34, 36 and received in an aligned apertures in the other of the plates) and, in this way, the blade may be easily assembled by simply abutting the upper blade edge against the rods and pin associated with each.

One of the plates 32, 34 has a pair of rods 40 welded to its upper edge and extending upwardly therefrom. Each rod 40 is adapted to slide upwardly into and through a hollow bushing 42 which is welded within an opening 44 in the beam 22 and which extends above and below the opening (see FIGS. 2 and 3). The rod 40 is secured within the bushing 42 by means of a cotter pin 46 and cooperating transverse hole in the rod. A coil spring 48 is interposed between a washer 50 adjacent the upper edge of the blade and the lower edge of the bushing 42, so as to spring load the blade assembly to a normally downward biased position, in engagement with the floor or surface to be coated. The blade 24 is self-adjusting, however, in that it is free to move up and down against or by the action of springs 48, as determined by the evenness of the floor or other surface. Since each blade 24, 26, 28 is similarly but separately mounted, it will be appreciated that unevenness of the floor along the length of the applicator may be accommodated by the individually self-adjusting blades. Vertical gaps or seams between adjacent blades may be covered by vertically extending rubber flaps 29 fixed to the beam 22 to prevent passage of coating material between the blades.

Figure 5:
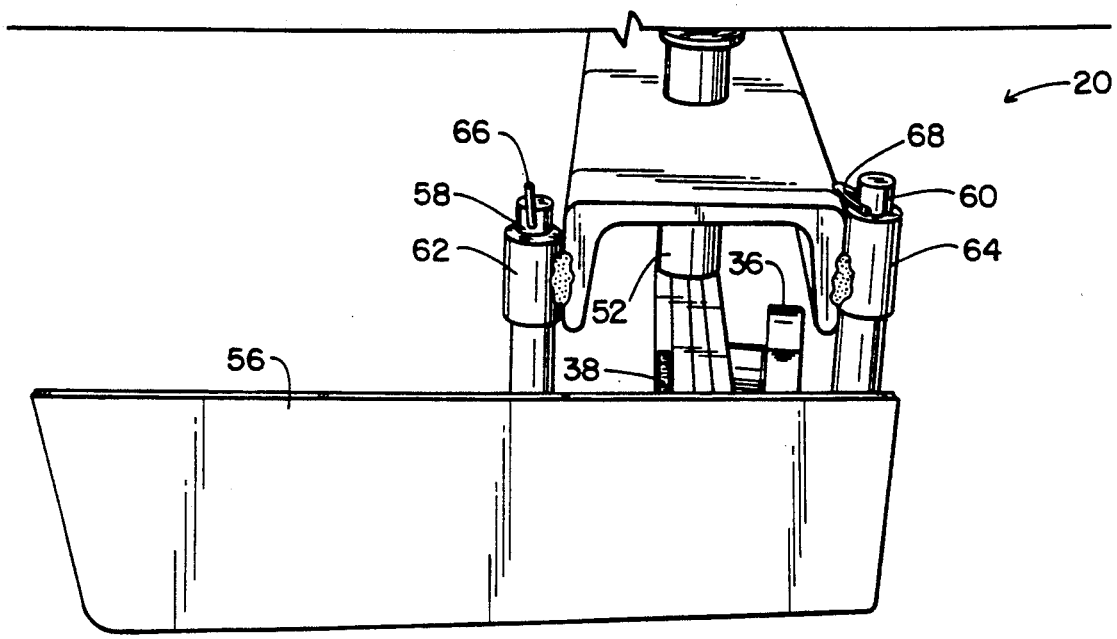
FIG. 5 is a perspective end view of the blade applicator assembly illustrated in FIG. 2.

As illustrated in FIG. 5, each coil spring 48 may be loosely surrounded by a guard 52 comprising another hollow bushing or sleeve interposed between washer 50 and bushing 42.

Again with reference to FIGS. 1 and 5, the blade applicator assembly 20 is also provided with end blades 54, 56 which may be mounted at either end of the channel member or beam 22 and which extend in a forward direction, relative to the direction of travel of the machine. The end blades 54, 56 are secured to the beam 22 by means of a pair of rods 58, 60 which are welded to the upper end of each blade and which extend vertically upwardly, to be received in hollow bushings or sleeves 62, 64 welded to the front and rear faces, respectively, of the channel member or beam 22. Rods 58, 60 extend through the bushings 62, 64 and are secured by cotter pins 66, 68. Thus, the blades are free to move up and down relative to the beam 22 under the influence of gravity, and as determined by the floor or other surface contour. The end blades are mounted immediately adjacent the ends of beam 22 so as to lie within about 1/16" to ⅛" from the adjacent edges of the outermost squeegee blades 24, 28. This prevents excess coating material from flowing around the blade applicator assembly, while still permitting independent movement of the squeegee blades and end blades.

Figure 5A:
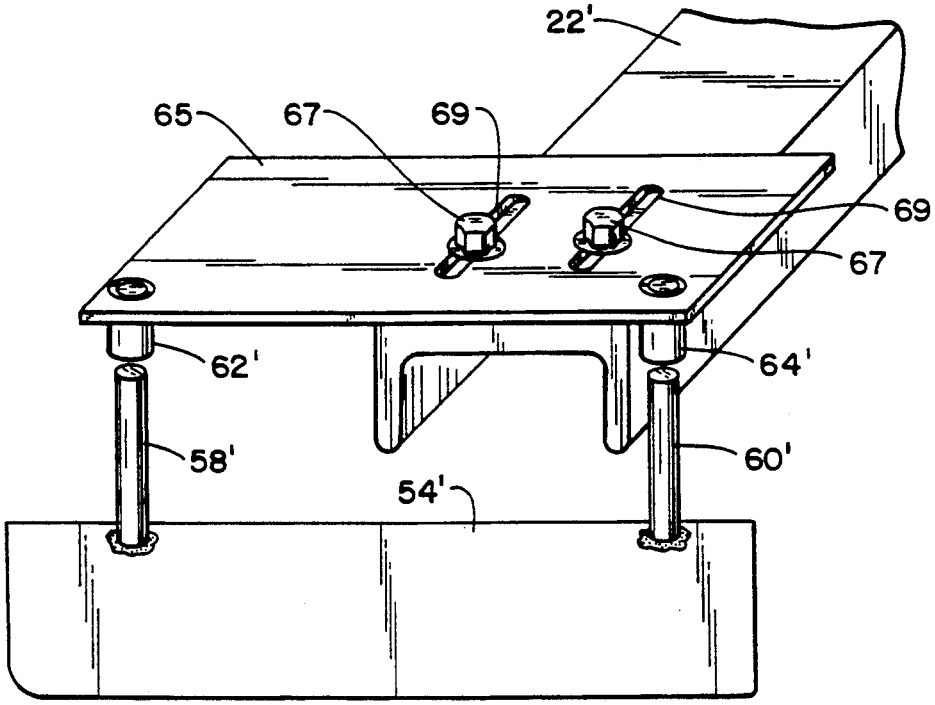
FIG. 5A is a partial perspective illustrating an alternative end blade mounting arrangement.

Referring to FIG. 5A, an alternative mounting arrangement for the end blades 54, 56 is illustrated, which provides for lateral adjustability vis-a-vis the channel member or beam 22. Thus, blade 54' (the mounting arrangement is identical for the opposite end blade) has a pair of vertical mounting pins 58', 60' which are slidably received in a pair of hollow bushings or sleeves 62', 64' which, in turn, are welded within apertures provided in a flat plate 65. Plate 65 is attached to the channel member or beam 22' by means of bolts 67 (and associated washers) passing through elongated slots 69 formed in the plate and threadably received in the channel member or beam. In this manner, the end blades may be adjusted as required in any given circumstance, but as noted above, it is desired to maintain a small gap between the end blades and the squeegee blades to insure independent and individual adjustability due to surface unevenness.

End blades 54, 56 are sharpened along their lower edges so as to clearly define the lateral extent of the coating material. This edge of the coating material will nevertheless "soften" to the extent of the flowability of the coating material. In the event of excess material, the roller trailing the rearward blade applicator assembly will smooth out the edge as described below. In addition, the lower edges of end blades 54, 56 on the forward applicator are slightly angled, i.e., downwardly about 5° from back to front, to accommodate any rearward "leaning" of the machine as it travels in a forward direction, thereby insuring flush and continuous engagement with the floor or other surface.

Extending rearward from the trailing blade applicator assembly only is an elongated roller 70 which includes a roller bar 72 pivotally mounted by any suitable means to the channel or beam 22 by means of a pair of struts 74, 76 which are also pivotally secured at opposite ends to the roller bar 72. The roller bar is designed to receive a roller cover 78 which extends over the full length of the bar 72 between struts 74, 76. Different and interchangeable roller covers 78 may be employed, depending upon the particular coating being applied. For example, the roller covers may have a nap ranging from about ¼" to about 1¼". In addition, a roller with circumferential spikes (approximately 1" in length) may be used on sand filled coatings (i.e., mortar, cementitious coatings and other non-skid coatings). This latter type roller is advantageous in that it will not pick up sand as it traverses the coating. In all cases, the roller 70 serves to smooth, texture and aerate the coating material, and provides the "finished" appearance.

As shown in the drawings, struts 74, 76 are secured between respective pairs of vertical flanges 80 and secured therebetween by cotter pins in a conventional manner. It may be advantageous in some circumstances to have the roller extend beyond the ends of the blade applicator assembly, and this can be easily accomplished by utilizing S-shaped struts as shown at 74A in FIG. 2A. Extending the roller length ensures that any coating material which has strayed from the edges defined by end blades 54, 56, will be smoothed, textured and aerated along with the remaining material.

As already noted, the above described blade applicator assembly may be used interchangeably with the forward and rearward applicator assemblies as disclosed in my two above identified prior patents. The manner in which blade applicator assemblies 20 of this invention may be utilized in combination with the applicator assemblies as disclosed in my two prior patents will be described below in connection with the application of a typical two coat epoxy system utilized in the resurfacing of parking lots and the like. It will be appreciated, however, that the invention is not limited to such use, but rather, may be used in the application of any number of resurfacing systems.

After cleaning and otherwise preparing the parking lot surface, after the following steps are taken:

1) A relatively thin and watery primer is applied over the surface, utilizing the blade and brush type applicator assemblies as disclosed in my two above identified prior patents.

2) After the primer has dried, a heavy epoxy coating, for example, 75 mils in thickness, is applied using the blade applicator assemblies 20 of this invention. As earlier indicated, the blades 24, 26 and 28 will be chosen with notch openings 30 selected as a function of the coating thickness. In this regard, it will be appreciated that the blade edges between the notches remain in contact with the surface. In one example, a coating material of a given viscosity may require a ½" notch size for a ¼" finished coating. It will be further understood that in some cases, it may be advantageous to have the notch size on the blades of the forward applicator assembly may be somewhat larger than the notch openings in the blades of the rearward applicator assembly in order to accommodate the thinning which naturally occurs as the material is initially distributed by the forward blade applicator assembly. In other words, using blades with notch openings 30 greater than the final thickness dimension, insures sufficient material for final thickness determination by the smaller notches of the blades on the rearward blade applicator assembly.

3) Following the application of the epoxy coating, sand is hand broadcast over the epoxy material until the latter is no longer visible. After the epoxy has cured, excess sand is brushed from the surface.

4) Steps 2 and 3 are then repeated; and

5) A thin wearing or top coat is applied using the blade and brush applicators as disclosed in my two prior patents.

Again, the above is only one example of the use of the blade applicator assemblies in accordance with this invention, and the blade applicator assemblies are equally suited for any number of other re-surfacing schemes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An blade applicator assembly for use with resurfacing apparatus, the applicator blade assembly comprising:

an elongated base member;

an elongated blade assembly mounted to said elongated base member, wherein said blade assembly comprises a plurality of blades aligned in end to end relationship; and an elongated roller extending rearwardly away from said base member and at least substantially coextensive in length with said blade assembly.

2. The assembly of claim 1 wherein said blade assembly is resiliently mounted to said elongated base member for spring loaded substantially vertical movement relative to said base member.

3. The assembly of claim 1 wherein said blade assembly includes at least one flexible blade sandwiched between a pair of rigid plates.

4. The assembly of claim 1 wherein said blade assembly includes at least one blade having a plurality of notches formed along its lowermost edge.

5. The assembly of claim 1 wherein said roller comprises a roller bar and a cover telescopically received over said roller bar.

6. The assembly of claim 5 and including a plurality of interchangeable roller covers, each having a different nap or surface texture.

7. The assembly of claim 1 and including a pair of end blades extending forwardly of said blade assembly and perpendicularly thereto.

8. The assembly of claim 7 wherein said end blades are free floating and self-adjusting.

9. Resurfacing apparatus comprising a central frame supported by a plurality of wheels;

a plurality of support arms extending forwardly and rearwardly of said central frame;

a forward blade applicator assembly secured to said support arms, extending forwardly of said central frame;

a rearward blade applicator assembly secured to said support arm extending rearwardly of said central frame;

wherein each of said forward and rearward blade applicator assemblies comprises an elongated base member and an elongated blade assembly mounted to said base member, wherein each of said forward and rearward blade applicator assemblies comprises a plurality of blades aligned in end to end relationship, and further wherein said rearward blade applicator assembly also includes an elongated roller extending rearwardly from said elongated base member.

10. Resurfacing apparatus as in claim 9 wherein said support arms are pivotally mounted to said central frame but wherein pivotal movement in one direction is limited by an adjustable stop.

11. Resurfacing apparatus as in claim 10 wherein the blades of each assembly are resiliently mounted to said elongated base member for spring-loaded substantially vertical movement relative to said base member.

12. Resurfacing apparatus as in claim 9 wherein each blade is sandwiched between a pair of rigid plates.

13. Resurfacing apparatus as in claim 10 wherein each blade has a plurality of notches formed along its lowermost edge.

14. Resurfacing apparatus as in claim 10 wherein said roller comprises a roller bar and a cover telescopically received over said roller bar.

15. Resurfacing apparatus as in claim 9 and including a plurality of interchangeable roller covers, each having a different nap or surface texture.

16. Resurfacing apparatus as in claim 9 and including a pair of end blades extending forwardly of said blade assembly and perpendicularly thereto.

17. Resurfacing apparatus as in claim 16 wherein said end blades are free floating and self-adjusting.

18. Resurfacing apparatus as in claim 17 wherein a lowermost edge of each end blade angles downwardly in a forward direction.

19. Resurfacing apparatus for distribution and smoothing of a predetermined thickness of coating material on a surface, the apparatus comprising:

at least one applicator assembly having first means for spreading the material uniformly over the surface at the predetermined thickness; second means for texturing and aerating the material, said first means located forward of said second means relative to a direction of travel of said resurfacing apparatus;

and third means for confining spread of said material in a direction perpendicular to said direction of travel, said third means comprising vertically and laterally adjustable end blades secured at opposite ends of said first means.

20. Resurfacing apparatus according to claim 19 wherein said first means comprises at least one resilient blade mounted for biased vertical movement.

21. Resurfacing apparatus according to claim 19 wherein said second means comprises a roller.

22. Resurfacing apparatus according to claim 19 wherein said second means comprises a roller.

23. An blade applicator assembly for use with resurfacing apparatus, the applicator blade assembly comprising:

an elongated base member;

an elongated blade assembly mounted to said elongated base member, said blade assembly including at least one flexible blade sandwiched between a pair of rigid plates; and an elongated roller extending rearwardly away from said base member and at least substantially coextensive in length with said blade assembly.

24. An blade applicator assembly for use with resurfacing apparatus, the applicator blade assembly comprising:

an elongated base member;

an elongated blade assembly mounted to said elongate base member;

an elongated roller extending rearwardly away from said base member and at least substantially coextensive in length with said blade assembly; and a pair of end blades extending forwardly of said blade assembly and perpendicularly thereto, said end blades being free floating and self-adjusting.

25. Resurfacing apparatus comprising a central frame supported by a plurality of wheels;

a plurality of support arms extending forwardly and rearwardly of said central frame;

a forward blade applicator assembly secured to said support arms, extending forwardly of said central frame;

a rearward blade applicator assembly secured to said support arm extending rearwardly of said central frame;

a pair of end blades extending forwardly of said forward and rearward blade applicator assemblies and perpendicularly thereto, said end blades being free floating and self-adjusting, and wherein the lower most edge of each end blade angles downwardly in a forward direction;

and further wherein each said forward and rearward blade applicator assemblies comprises an elongated base member and an elongated blade assembly mounted to said elongated base member, said rearward blade applicator assembly including an elongated roller extending rearwardly from said elongated base member.

* * * * *